United States Patent [19]

Tesch

[11] 4,423,591

[45] Jan. 3, 1984

[54] BRACELET, WATCHBAND OR LIKE LINK

[75] Inventor: Bernhard Tesch, Ennetbürgen, Switzerland

[73] Assignees: Zwyro A.G., Schaffhausen; Tesch A.G., Ennetbürgen, both of Switzerland

[21] Appl. No.: 372,081

[22] Filed: Apr. 26, 1982

[30] Foreign Application Priority Data

Apr. 27, 1981 [DE] Fed. Rep. of Germany ..... 3116585

[51] Int. Cl.[3] ..... F16G 13/18

[52] U.S. Cl. ..... 59/80; 59/91

[58] Field of Search ..... 59/79, 80, 82, 13, 15, 59/25, 31, 91, 16, 1

[56] References Cited

U.S. PATENT DOCUMENTS 3,195,301 7/1965 Bello ..... 59/91

3,425,214 2/1969 Meng ..... 59/91

FOREIGN PATENT DOCUMENTS 2740916 3/1979 Fed. Rep. of Germany ..... 59/80

*Primary Examiner*—Gene P. Crosby

*Attorney, Agent, or Firm*—Diller, Ramik & Wight

[57] ABSTRACT

This disclosure is directed to a link for a bracelet, wrist watchband or the like which is formed of one or more elements defining a body having opposite longitudinal and transverse edge portions, one of the longitudinal edge portions defining a transversely outwardly directed projection and the other of the longitudinal edge portions defining a recess generally aligned with and contour to the configuration of the projection. A slider is mounted for reciprocal sliding movement in a guide channel disposed transversely of the body and opening outwardly through one or both of the opposite longitudinal edge portions. A spring biases the slider in an outward direction.

15 Claims, 5 Drawing Figures

BRACELET, WATCHBAND OR LIKE LINK

The present invention relates to manufacture of the links for bracelets, wrist watchbands, or the like and is particularly directed to a link which is formed of several individual members or plates forming a single body united together in an articulated manner wherein a connection between adjacent links is formed by sliders housed in guide channels which are received in interlocking relationship in recesses of adjacent links and with the guide channels being masked or covered so as not to be visible and, thus, imparting an aesthetic appearance to the links.

Each link body is provided with one or more hook-like projections along one longitudinal edge whose configurations correspond to recesses along an opposite longitudinal edge so that the projections and recesses can be interlocked to form a band from a plurality of such links.

Preferably, automatic latching and/or securing elements in the form of sliders are provided which prevent the links from becoming disconnected after the hook-like projections and recesses are interconnected.

The latching and/or securing elements are preferably in the form of sliders received in a reciprocal fashion in associated recesses, and the sliders are preferably spring-loaded to permit automatic latching between the sliders and adjacent slider/receiving recesses. Furthermore, the sliders are so housed within an associated link or the body thereof of the associated wristband that the sliders can not be lost either in the assembled state or while assembling the same.

It has been proposed to insert such securing elements or sliders in recesses during the assembly of the layers of a multi-layer link. However, such manufacture is both difficult and troublesome.

It is, therefore, a primary object of the present invention to eliminate the difficulties encountered in multi-layer or multi-element link designs by so constructing the links or the individual layers thereof that the securing elements or sliders and the associated springs can be inserted into recesses of the individual links or link bodies from one or both sides of an associated slider-receiving guide channel, and, once so inserted, the sliders are prevented from being inadvertently or accidentally dissassembled therefrom.

In keeping with the present invention, the problems associated with past locking, latching or like locking elements or sliders is solved by the present invention by maintaining adjoining individual links in detachable though assembled interconnected relationship by sliders mounted in a reciprocal manner within their associated guide channels and by keeping the sliders under constant spring pressure so that after insertion and interconnection of associated adjacent links the force of the springs urge the locking sliders to their locked positions at which they not only hold the adjacent links interlocked but also prevent the sliders from dropping out of their associated guide channels.

In keeping with one specific aspect of the invention, the locking slider and its associated spring are inserted from the same side of the link or link bodies to the associated guide channel or duct. However, in many cases it is also appropriate in keeping with the invention to form the guide channel open at opposite ends through longitudinal edges of the link bodies such that the latching slider and its associated spring can be inserted from either longitudinal side of the link. Preferably, these recesses, guide channels, etc. are covered or masked by a link member which is one of a plurality of members forming the individual link. In the latter fashion, the slider and spring are not visible from either the outside or the inside of the link, thereby rendering the link aesthetic acceptable.

In further accordance with this invention, the slider further includes retaining means in the form of a notch, step or a stamped-out section opening laterally through one of its sides relative to the direction of reciprocal motion of the slider with the notch, step or stamped-out section receiving a leg of a torsion spring housed within a recess opening toward the guide channel for the slider. In this fashion, the interconnection between the leg of the torsion spring and the notch, step or stamped-out section of the slider maintains both the slider and the spring in their assembled relationship and precludes either from being inadvertently or accidentally dissassembled from the associated link. While a torsion spring might be utilized in one aspect of the invention, the guide channel might also include a blind end closed at a bottom wall thereof and in such case in lieu of the torsion spring, a spring is provided of a generally accordian-shaped configuration which is sandwiched between the bottom face of the slider and the blind end wall of the guide channel. In the case of the accordian-like spring, the slider associated therewith preferably includes a tongue which is bent laterally or transversely outwardly into an offset of the guide channel which confines the slider within the guide channel and precludes the inadvertently remover of the slider from the guide channel. Preferably, the guide channel includes an inclined surface adjacent the blind end which bends the offset tongue of the slider to its offset position when the slider is inserted into the guide channel.

In the case of the torsion spring, the same is preferably housed in a recess which opens in a diversion fashion toward the guide channel and the notch of the slider reciprocally mounted therein. The dimensions of the diverging recess are such that the torsion spring seats therein with two of its legs bearing against two diverging reaction surfaces of the diverging recess which tend to urge the spring outwardly toward the slider and its notch, and the latter assures that one of the legs of the torsion spring is, in fact, received within the notch of the slider thereby maintaining the slider confined within the guide channel between its operative positions. However, the dimensions of the spring-receiving recess and the guide channel are such that the slider can be intentionally withdrawn outwardly of its guide channel for dissassembling purposes.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
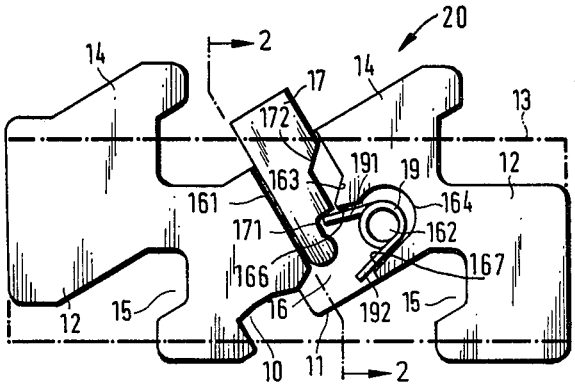
FIG. 1 is a top plan view of a link constructed in accordance with this invention which is made of three stamped layers or members, and illustrates one of the top or or covering layers in broken lines for clarity in overlying mass relationship to a spring-loaded slider latching element.
Figure 2:
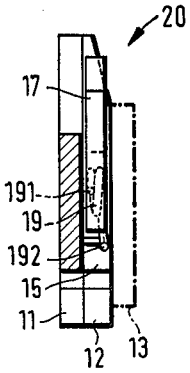
FIG. 2 is a sectional view taken along line 2—2 of FIG. 1, and illustrates the manner in which the slider and spring are sandwiched between innermost and outermost plates or layers of the link.

Reference is first made to FIGS. 1 and 2 of the drawings which illustrate a link generally designated by the reference numeral 20 for a wristband, watchband, bracelet or the like and which is formed of three stamped metal or plastic layers 11, 12 and 13. The layers 11, 12 and 13 are welded or otherwise joined together after they have been stamped from sheet material. Reference is made to applicant's German application P 31 10 484.3 filed in Germany on Mar. 18, 1981 for details of the manner in which the layers 11, 12, and 13 are stamped and then united to form the link 20.

Figure 3:
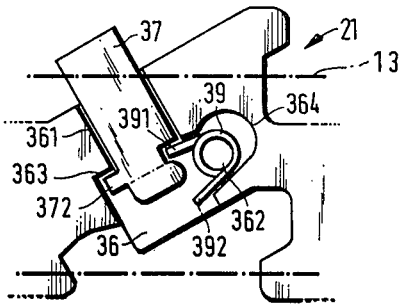
FIG. 3 is a top view of a link similar to the link of FIG. 1, and illustrates a modification in which the slider includes a tongue or projection which engages a step of one of the layers to prevent the slider from inadvertently becoming dislodged from its associated guide channel.
Figure 5:
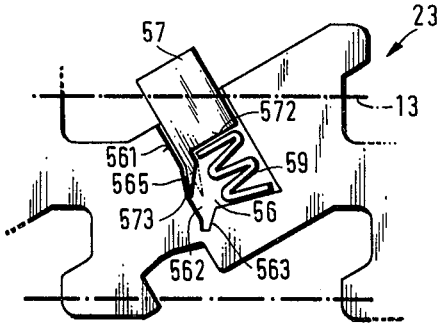
FIG. 5 is a top plan view of another link of this invention, and illustrates a tongue of a slider offset transversely of the associated guide channel to prevent the slider from being inadvertently withdrawn therefrom.
Figure 4:
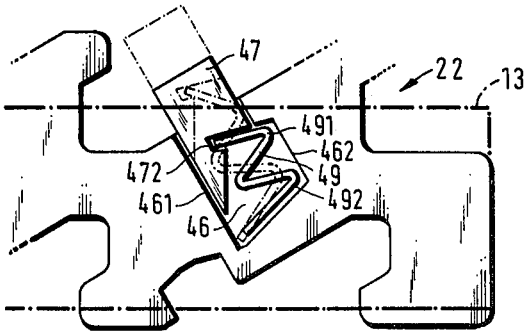
FIG. 4 is a top plan view of another embodiment of this invention, and illustrates an accordian-like spring sandwiched between and end face or wall of a blind guide channel or duct and its associated slider latching element.

The layer 13 is the upper, outer or cover layer of the link 20 and is indicated only by dot-dash lines in FIGS. 1 and 2 simply for the sake of clarity, and a like dot-dash lines are utilized in the remaining figures for the same outer or cover layer 13 which also bears the same reference numeral in FIGS. 3 through 5 of the drawings. The layers 11 and 12 are each contoured along opposite longitudinal edge portions (unnumbered) to form hook-shaped transversely directed projections 14 on the side of each link 20 which is to be connected to a neighboring link with corresponding recesses 15 along the longitudinal edge portions of the link 20 opposite the projections 14. The projections 14 and the recesses 15 are formed in both layers 11, 12, but are not formed in the layer 13.

The layer or member 12 is the middle layer of the link 20 and is thus sandwiched between the layers or members 11, 13, as is most apparent from FIG. 2 of the drawing. The layer 12 has a stamped-out central section which forms a recess 16, a guide channel or duct 161, and a recess torsion 162 which opens in a divergent fashion toward and forms a continuation of and part of the recess 16.

Thus, the recess 16, the recess portion 162 and the guide channel 161 define a single interconnected recess which opens upwardly as viewed in FIG. 1 and outwardly at opposite ends through both of the longitudinal edge portions (unnumbered) of the middle layer or member 12. A reciprocal latching or locking slider 17 is housed within the guide channel or duct 161 and is designed for reciprocal sliding motion therein with a spring 19 being utilized to place the slider 17 under an outwardly directed biasing force which normally projects a terminal end portion (unnumbered) of the slider 17 to the position shown in FIG. 1. In the latter position, the slider 17 is designed to enter and seat within a recess 10 of an associated or neighboring link when such links 20 are latched together with the projections 14 of one link in the recesses 15 of an adjoining link. The purpose of the slider 17 engaging the associated recess 10 is, of course, to prevent adjacent links from becoming inadvertently or accidentally detached from each other.

When adjacent links 20 are interlocked together with the projections 14 and the recesses 15, the slider 17 will be moved inward of the guide channel 161 from the position shown in FIG. 1 to slightly compress the spring 19, therefore, at this point, the spring 19 holds the slider 17 in intimate contact with the recess 10 and, therefore, maintains adjacent links 20 in assembled relationship. However, the slider 17 may be easily forced back into the guide channel 161 by utilizing a pointed tool inserted into the recess 16 and into a notch or recess 171 of the slider 17 to retract the slider 17 as far as possible into the channel 161 to disengage its exposed end portion (unnumbered) from the recess 10 of an adjoining link to permit such links to be dissassembled. Thus, in this manner adjacent interconnected links can be conveniently separated from each other.

In order to limit and control the movement of the slider 17, provision is made for the spring 19, which is, of course, a torsion spring, to be seated in a particular manner within the recess 16 and the recess portion 162. The recess portion 162 is defined by a rear or bight wall or surface 164 which merges with a pair of outwardly diverging walls or surfaces 166, 167 of a shape corresponding to the disposition of a pair of legs 191, 192 of the spring 19. The legs 191, 192 engage the respective surfaces 166, 167 and due to the torsion nature of the spring 19 and the contact of the legs 191, 192 against the surfaces 166, 164, the spring 19 tends to move outwardly of the recess portion 162 and toward the recess 16 and a lower end portion (unnumbered) of the slider 17 and particularly toward a notch or recess 171 thereof which opens toward the recess portion 162. In this fashion, the leg 191 of the spring 19 is received in the recess or notch 171 of the slider 17, while the other leg 192 bears against the surface 167 of the recess portion 162. Thus, the spreading motion of the torsion spring 19 spreads the legs 191, 192 which moves the spring 19 outwardly of the recess portion 162, but the outward movement of the spring is confined by the engagement of the leg 191 within the notch 171 of the slider 17. Inward motion of the slider 17 is limited by the degree that the leg 191 can be moved toward the leg 192 and also by a pair of stops or stop surfaces 172, 163 formed by the slider 17 and the guide channel 161, respectively. Outward movement of the slider 17 is limited by the relationship of the leg 191 relative to the notch 171.

The slider 17 and the torsion spring 19 can be inserted into the guide channel 161 and the recess 16 and recess portion 162, respectively, after all three layers 11, 12 and 13 of the link 20 have been assembled by inserting the springs 19 from the underside of the link 20, as viewed in FIGS. 1 and 2, and inserting the slider 17 from the upper side of the link 20, again as viewed in FIGS. 1 and 2. The latter insertion of the slider 17 and the spring 19 can take place simultaneously or in consecutive stages. In order for the leg 191 of the spring 19 to engage the notch or recess 171 of the slider 17, the spring 19 must be forced together with its loop (unnumbered) as far as possible toward the bight wall or surface 164. When thus positioned, the slider 17 can be freely moved downwardly in the guide channel 161 until the notch 171 is generally aligned with the surface 161 at which time the spring 19 is released and the inherent torsion thereof with the legs 191, 192 bearing against the surfaces 166, 167, respectively, will then urge the spring 19 away from the wall 164 and bring the leg 191 into engagement with the recess 171 of the slider 17. Furthermore, if it is desired to remove the slider 17 and/or the spring 19 from the associated channels or recesses 161, 16 and 162, one need but insert an intrument to the recess 16 to force the spring 19 rearward toward the wall 164 whereby the leg 191 is withdrawn from the notch 171 and the slider 17 can be withdrawn from the guide channel 61 upwardly, again as viewed in FIGS. 1 and 2 of the drawings.

When it is desired to insert the slider 17 from either side into the guide channel 161, the embodiment of FIGS. 1 and 2 can be modified as shown by a link 21 of FIG. 3. The link 21 includes a slider 37 likewise reciprocally mounted within a guide duct or channel 361 which is in communication with the recess 36 and the recess or recess portion 362, the latter three elements corresponding to the elements 161, 16 and 162 of the link 20 of FIGS. 1 and 2. However, the guide channel or duct 361 is of a constant width throughout its length and does not include the abutment or stop surfaces 172, 173 of the link 20 of FIGS. 1 and 2. In lieu of the abutment surfaces 172, 173, the slider 37 is provided with laterally projecting stop means 372 in the form of a tongue or tab which is received in a notch or slot 363 forming part of the recess 36. A spring 39 includes legs 391, 392 which operate just as the spring 19 to normally urge the slider 37 in an outward or upward direction, as viewed in FIG. 3 of the drawings. However, the upward motion of the slider 36 is limited by the stop or tab 372 contacting the notch or recess 363 in the manner readily apparent from FIG. 3 of the drawings. In this fashion, the spring 39 and slider 37 can be inserted from the bottom of the link 21, as viewed in FIG. 3, by utilizing a tool to push the spring 39 toward a bight wall 364 of the recess 362 after which the slider 37 can be inserted from the bottom and the spring 39 released to permit the leg 391 to be received within the notch (unnumbered) of the slider 37. Obviously, in this embodiment, the slider 37 can not be inserted into its guide channel 361 from the top of the link 21, again as viewed in FIG. 3 of the drawings.

An embodiment of the invention shown in FIG. 4 is generally designated by the reference numeral 22 to define a link which includes the slider 47 inserted into a guide channel 461 from the top of the link 22, as viewed in FIG. 4. The link 22 has associated therewith an accordian-like spring 49 which normally has a configuration shown in dash lines but can be compressed to the configuration shown in solid line in FIG. 4. Thus, the spring 49 can be inserted into an associated recess 46 with one of its legs 491 being received in a recess 472 of the slider 47 and another of its legs 492 resting upon a blind end or wall (unnumbered) of the recess 46. Once the slider 47 is inserted from its phantom to its solid outline position along the guide channel 461, the spring 49 is compressed until it is generally at its solid outline position at which time a bight wall 462 defines a recess portion which accommodates portions of the spring 49 and permit the spring 49 from totally dislodging the slider 47 from the guide channel 461. Thus, the spring 49 is confined within the recess portion or bight 462 and in turn its leg 491 confines the slider 47 against inadvertent withdrawal from the guide channel 461 by the engagement thereof with the notch 472.

A modification of the link 22 of FIG. 4 is shown by an associated link 23 of FIG. 5 in which a slider 57 and an accordian spring 59 are inserted into a recess 56 and in associated guide channel 561 through an upper portion of the link 23. The spring 59 rests by one of its end (unnumbered) against an end face or stop 572 of the slider 57, while its other end bottoms on a blind end wall of the recess 56. The recess 56 flares at its lower end over some distance toward the side away from the spring 59 to form an offset portion or flared section 562 which receives a downwardly projecting portion or tongue 573 of the slider 57. The tongue 573 normally occupies the dash line position shown in FIG. 5 prior to the slider 57 being first inserted within the guide channel 561. However, upon the slider 57 being first inserted into the guide channel 571, the tongue 573 engages in inclined surface 563 and is, thus, bent from the phantom outline to the solid outline position shown in FIG. 5 at which time the tongue 573 will be received in the offset 562 and will, thus, prevent the slider 57 from being dislodged from the guide slot 561 by the spring 59.

Although only a preferred embodiment of the invention has been specifically illustrated and described herein, it is to be understood that minor variations may be made in the apparatus without departing from the spirit and scope of the invention, as defined in the appended claims.

What is claimed is:

1. A link for a wristband comprising a body having opposite longitudinal edge portions and opposite transverse edge portions, one of said longitudinal edge portions defining a transversely directed projection, another of said longitudinal edge portions defining a recess generally aligned with and contoured to the general configuration of said projection whereby said link and similar links can be joined in projection-recess interconnected relationship, a transversely disposed guide channel in said body opening outwardly through an associated longitudinal edge portion, a slider mounted for reciprocal sliding movement in said guide channel and transversely relative to said associated longitudinal edge portion between first and second projected positions at each of which a terminal end portion of said slider is disposed outwardly of said associated longitudinal edge portion, spring means for biasing said slider to said first projected position, means for confining said spring against inadvertent dislodgement from a spring-receiving recess of said body, and said confining means being defined by a portion of said slider.

2. The link as defined in claim 1 wherein said body is so constructed and arranged as to permit said slider and spring means to be inserted into said channel and said spring-receiving recess from the same longitudinal edge portion of said body.

3. The link as defined in claim 1 wherein said channel opens outwardly of said body through a first of said longitudinal edge portions and said spring-receiving recess opens outwardly of said body through a second of said longitudinal edge portions, and said slider and spring means can be inserted into said respective channel and spring-receiving recess from the same longitudinal edge portion of said body.

4. The link as defined in claim 1 wherein said slider portion has a notch, and a portion of said spring means is received in said notch.

5. The link as defined in claim 1 wherein said slider portion has a notch opening in a direction toward said spring-receiving recess, and a portion of said spring means is received in said notch.

6. The link as defined in claim 1 wherein said spring means is a torsion spring having a loop and a pair of legs, said loop being disposed in said spring-receiving recess, and said confining means portion is a recess receiving one of said pair of legs.

7. The link as defined in claim 1 wherein said spring-receiving recess opens in a direction transversely of and into said guide channel, said spring-receiving recess is of a diverging opening configuration toward said guide channel, said spring-receiving recess being defined by a bight surface and a pair of diverging surfaces, said spring means being a torsion spring having a loop and a pair of legs, said loop being disposed, generally contiguous said bight surface, said pair of legs being disposed one generally contiguous one of said pair of diverging surfaces, and said confining means portion is a recess receiving one of said pair of legs.

8. The link as defined in claim 1 wherein said guide channel has a blind end, said spring means is sandwiched between said slider and said blind end, said guide channel includes an outward offset, and said slider portion is a bent portion received in said outward offset.

9. The link as defined in claim 1 wherein said guide channel has a blind end, said spring means is sandwiched between said slider and said blind end, said guide channel includes an outward offset, said slider portion is a bent portion received in said outward offset, and means adjacent said blind end for bending said slider portion to form the same into said bent portion upon movement of said slide portion toward said blind end.

10. The link as defined in claim 1 including a plate overlying said body in masking relationship to said guide channel and said spring-receiving recess.

11. The link as defined in claim 1 wherein said confining means is further constructed and arranged for confining said slider from inadvertent dislodgement from said guide channel.

12. The link as defined in claim 1 wherein said body is so constructed and arranged as to permit said slider and spring means to be inserted into said channel and said spring-receiving recess from a longitudinal side of said body opposite said associated longitudinal edge portion.

13. The link as defined in claim 1 wherein said body is so constructed and arranged as to permit said slider and spring means to be inserted into said channel and said spring-receiving recess from a longitudinal side of said body opposite said associated longitudinal edge portion, said guide channel passes completely through said body and additionally opens outwardly through a longitudinal edge portion opposite said associated longitudinal edge portion.

14. The link as defined in claim 2 wherein said confining means is further constructed and arranged for confining said slider from inadvertent dislodgement from said guide channel.

15. The link as defined in claim 3 wherein said one longitudinal edge portion and said first longitudinal edge portion are one and the same longitudinal edge portion.

* * * * *